US005278741A

United States Patent [19]

Ehrman

[11] Patent Number: 5,278,741

[45] Date of Patent: Jan. 11, 1994

[54] LIGHT BULB ASSEMBLY PARTICULARLY USEFUL FOR MINIATURE LAMPS

[75] Inventor: Moshe Ehrman, Doar Na Haluza, Israel

[73] Assignee: Silvestri Corporation, Chicago, Ill.

[21] Appl. No.: 906,094

[22] Filed: Jun. 29, 1992

[30] Foreign Application Priority Data

Oct. 23, 1991 [IL] Israel ..... 99826

[51] Int. Cl.[5] ..... H01R 33/00

[52] U.S. Cl. ..... 362/226; 362/249; 362/457; 439/356; 439/375

[58] Field of Search ..... 362/226, 249, 457, 806; 439/356, 375, 680, 702, 707, 734

[56] References Cited

U.S. PATENT DOCUMENTS

| | | | |
|---|---|---|---|
| 3,660,801 | 5/1972 | Paulfus | 339/97 L |
| 3,671,923 | 6/1972 | Rieth | 339/93 L |
| 3,805,215 | 4/1974 | Davis | 339/65 |
| 3,892,463 | 7/1975 | Horan | 339/144 R |
| 4,547,840 | 10/1985 | Tinder | 362/226 |
| 4,631,650 | 12/1986 | Ahroni | 362/249 |
| 4,660,919 | 4/1987 | Levy | 339/99 |
| 4,679,126 | 7/1987 | Van Sickler | 362/226 |
| 4,779,177 | 10/1988 | Ahroni | 362/236 |
| 4,801,275 | 1/1989 | Ikeda et al. | 439/350 |
| 4,803,396 | 2/1989 | Kelner | 313/318 |
| 4,807,098 | 2/1989 | Ahroni | 362/249 |
| 4,822,302 | 4/1989 | Dorleans | 362/226 |
| 4,870,547 | 9/1989 | Crucefix | 362/123 |
| 4,899,266 | 2/1990 | Ahroni | 362/238 |
| 4,915,642 | 4/1990 | Lin et al. | 439/352 |
| 4,970,632 | 11/1990 | Tseng | 362/226 |
| 4,975,813 | 12/1990 | Chen | 362/226 |
| 4,999,751 | 3/1991 | Chen | 362/226 |
| 5,001,615 | 3/1991 | Stefanelli | 362/226 |
| 5,012,397 | 4/1991 | Tseng | 362/237 |
| 5,013,258 | 5/1991 | Schaef | 439/347 |
| 5,029,056 | 7/1991 | Patterson, Jr. | 362/226 |
| 5,137,465 | 8/1992 | Chwang | 439/356 |
| 5,154,508 | 10/1992 | Ahroni | 362/226 |

*Primary Examiner*—Richard R. Cole
*Assistant Examiner*—Alan B. Cariaso
*Attorney, Agent, or Firm*—Benjamin J. Barish

[57] ABSTRACT

A light bulb assembly includes a light bulb, a base receiving the light bulb, and a socket receiving the base. The base is formed with a displaceable arm terminating in a locking element. The socket is formed with an opening through a wall having an edge adapted to receive the locking element to lock the base to the socket. The base is releasable from the socket by passing a pointed implement through the opening to displace the finger and thereby to release the locking element.

16 Claims, 3 Drawing Sheets

FIG.3
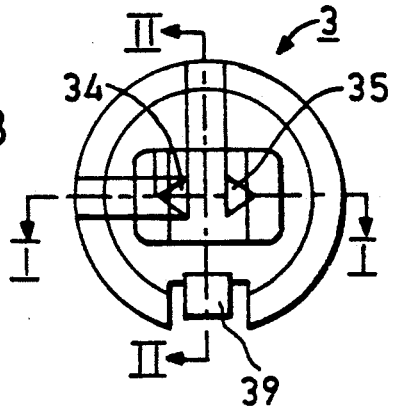
FIG.3b
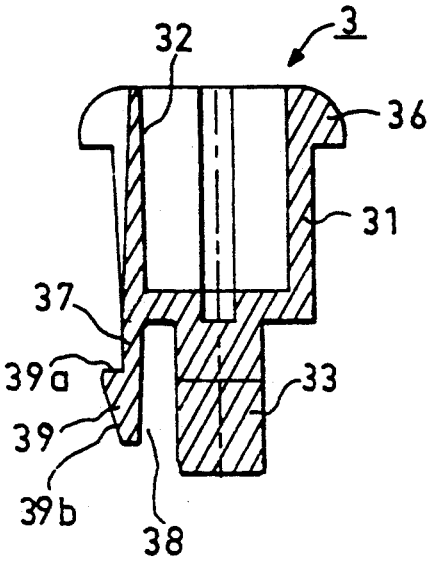
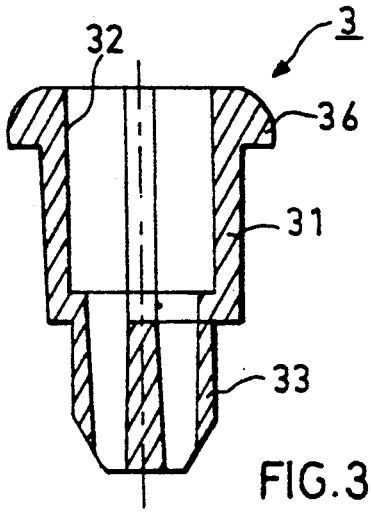
FIG.3a
FIG.3c
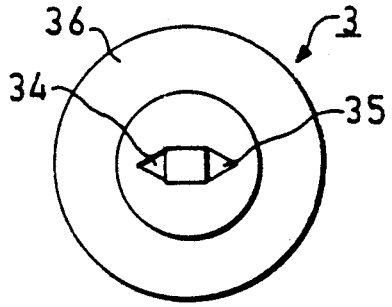

LIGHT BULB ASSEMBLY PARTICULARLY USEFUL FOR MINIATURE LAMPS

FIELD AND BACKGROUND OF THE INVENTION

The present invention relates to a light bulb assembly, and particularly to such an assembly useful as a miniature lamp.

One common form of light bulb assembly used, for example, in miniature lamps for Christmas tree decorations, includes a light bulb, a base receiving the light bulb, and a socket receiving the base. The light bulb includes an envelope and a pair of electrically-conductive wires projecting from one end Of the envelope, which wires are passed through the base and folded back over the outside of the base to fix the light bulb to the base. The base, with the light bulb fixed to it, is inserted into the socket and is retained therein by a friction fit between the base and socket.

However, a friction fit between the base and socket is not always sufficient to positively retain the light bulb and its base within the socket. As a result, it frequently happens, particularly under rough handling conditions, that the light bulb and its base separate from the socket.

One solution to this problem was to provide a wire-type clamp passing through the socket and the base to positively fix the base to the socket. However, this solution requires the addition of an extra element, which thereby increases the overall cost of the assembly; moreover, it requires an extra manipulation in passing the wire clamp through the socket and the base, thereby increasing the cost of assembling the base to the socket.

OBJECTS AND BRIEF SUMMARY OF THE INVENTION

An object of the present invention is to provide a light bulb assembly which securely holds the lamp and its base in the socket. Another object of the invention is to provide such a light bulb assembly which is constituted of a few simple parts capable of being produced and assembled in volume and at low cost.

According to the present invention, there is provided a light bulb assembly including a light bulb, a base receiving the light bulb, and a socket receiving the base. The base is formed with a cavity at one end for receiving the light bulb, and with a displaceable arm extending from its opposite end and having a locking element at an outer tip thereof. The socket includes a side wall for enclosing the base. The side wall is formed with an opening therethrough having an edge adapted to receive the locking element to lock the base to the socket, the base being releasable from the socket by passing a pointed implement through the opening in the side wall to displace the arm and thereby to release the locking element from the edge. The locking element is tapered such as to cause the arm, upon inserting the base into the socket, first to be deflected away from the opening until the locking element becomes aligned with the opening, and then to snap into the opening.

According to further features in the preferred embodiment of the invention described below, the socket includes an upper section of large diameter for receiving the base, and a lower section of smaller diameter for accommodating electrical conductors for energizing the lamp, the opening being formed at the juncture of the upper and lower sections; in addition, the opening is elongated in the axial direction of the socket.

According to still further features in the described preferred embodiment, the outer tip of the locking element is tapered such as to cause the arm, upon inserting the base into the socket, first to be deflected away from the opening until the locking element becomes aligned with the opening, and then to snap into the opening.

It will thus be seen that a light bulb assembly constructed in accordance with the foregoing features provides a locking arrangement which positively fixes the light bulb base to the socket, and which also actuates the locking means automatically upon inserting the base into the socket. Thus, such a light bulb assembly can be produced and assembled inexpensively.

Further features and advantages of the invention will be apparent from the description below.

BRIEF DESCRIPTION OF THE DRAWINGS

The invention is herein described, by way of example only, with reference to the accompanying drawings, wherein:

FIG. 3 is a bottom plan view of the base of the light bulb assembly of FIGS. 1 and 2, FIGS. 3*a* and 3*b* being sectional views along lines I—I and II—II of FIG. 3, and FIG. 3*c* being a top plan view.

DESCRIPTION OF A PREFERRED EMBODIMENT

Figure 1:
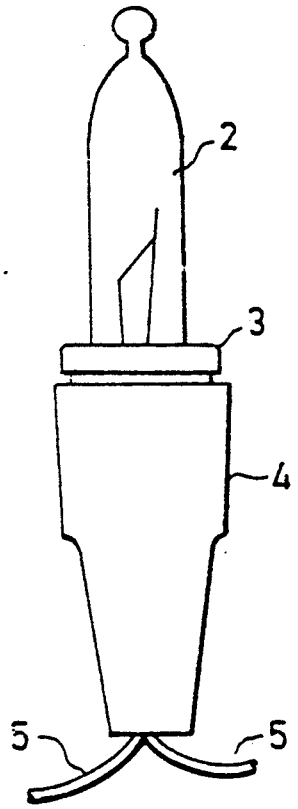
FIG. 1 illustrates one form of light bulb assembly constructed in accordance with the present invention.
Figure 2:
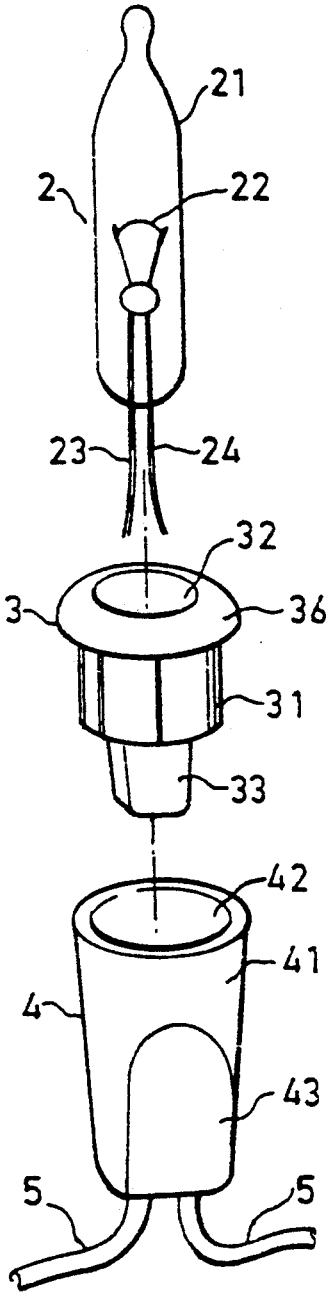
FIG. 2 illustrates the light bulb assembly of FIG. 1 in its exploded condition.
Figure 4C:
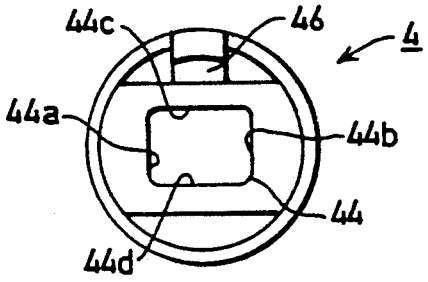
FIG. 4 is a side elevational view of the socket in the assembly of FIGS. 1 and 2, FIGS. 4*a* and 4*b* being sectional views along lines III and III and IV—IV, respectively, and FIG. 4*c* being a top plan view.
Figure 4A:
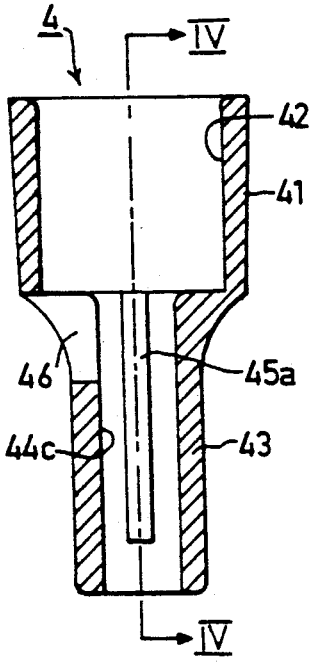
Figure 4:
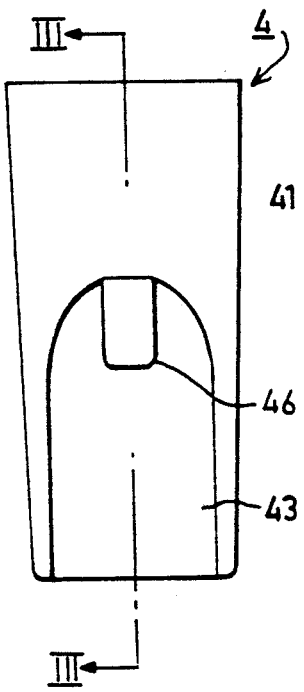
Figure 4B:
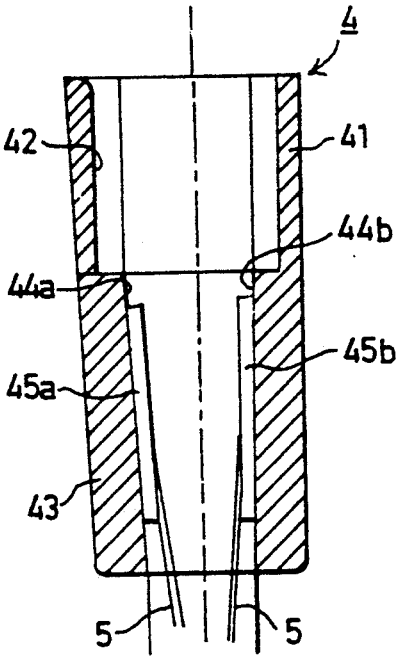

The light bulb assembly illustrated in the drawings is of the type commonly used in miniature lamps such as are included in Christmas tree decorations and the like. Generally, the lamps are arranged in a string connected in series or in parallel. Such assemblies include three main parts, namely a light bulb 2, a base or husk 3 for receiving the light bulb, and a socket 4 for receiving the base and light bulb and having electrical conductors 5 connecting the light bulb 2 to a power supply.

The illustrated light bulb 2 is of a conventional type. It includes an evacuated glass envelope 21, an incandescent filament 22, and a pair of electrically-conductive wires 23, 24 connected to the filament and exiting through the lower end of the envelope 21.

The base 3, as more particularly illustrated in FIGS. 3 and 3*a*–3*c*, is of plastics material. It includes an upper cylindrical section 31 of large diameter formed with a cylindrical cavity 32 at one end for receiving the lower end of bulb 2. The base 3 further includes a stem 33 of generally rectangular section extending from its opposite end parallel to the longitudinal axis of base 3 and formed with a pair of holes 34, 35 (FIG. 3) for receiving the electrical wires 23, 24 of bulb 2. The latter wires are longer than stem 33 such that they permit the ends of the wires to be folded back over the outer surface of the stem and thereby to fix the bulb within the base. The mouth of cavity 32 is circumscribed by a rim 36 of larger diameter than the base cylindrical section 31.

Base 3 is further integrally formed with an arm 37 extending axially of the base parallel to its stem 33 and separated therefrom by a slot 38 permitting some displacement of the arm towards and away from stem 33. Arm 38 terminates in a locking element 39 having a locking shoulder 39*a* and a tapered surface 39*b* from the shoulder to the tip of the arm.

Socket 4, as more particularly illustrated in FIGS. 4 and 4*a*–4*c*, is also made of plastics material. It includes an upper side wall section 41 formed with a cylindrical cavity 42 for enclosing the upper section 31 of base 3, and with a lower side wall section 43 formed with a rectangular cavity 44 for enclosing stem 33 of the base. Cavity 44 includes a pair of opposed short sides 44*a*, 44*b*, and a pair of opposed long sides 44*c*, 44*d*. A pair of contacts 45*a*, 45*b* are bonded to the short sides 44*a*, 44*b* of cavity 44 and are connected to the electrical conductors 5 (FIG. 1) supplying electric power to the bulb. The electrical contacts 45*a*, 45*b* are so located so as to be engaged by the ends of the wires 23, 24 which are bent over the outer face of stem 33 of the base 3 to establish electric continuity from the electric conductors 5 to the bulb 2.

Socket 4 is further formed with an opening 46 in its lower side wall section 43 at the juncture with its upper side wall section 41. As can be seen particularly in FIG. 4, opening 46 is of generally rectangular configuration and is elongated in the axial direction of the socket. Opening 46 is adapted to receive the locking element 39 formed at the end of arm 37 of base 3 to lock the base within the socket.

The manner of assembling the bulb 2 to the base 3 and to the socket 4 will be apparent from the above description.

Thus, bulb 2 is first inserted into cavity 32 of base 3, with the two wires 23, 24 of the bulb passing through openings 34, 35 extending through stem 33 of the base. As described earlier, the wires 23, 24 are longer than the stem and therefore may be folded over the outer face of the stem, to firmly fix the bulb to the base.

The base 3, together with the bulb 2 fixed therein, may then be easily inserted into cavity 42 of the socket 4. During the initial insertion movement, the tapered surface 39*b* of locking element 39, formed at the outer end of the diplaceable arm 37, first engages the inner surface of cavity 42 in socket 4, thereby deflecting the arm 37 towards stem 33. The base is then pressed further into the socket until the shoulder 39*a* of locking element 39 clears the upper edge of opening 46, at which time the locking element 39 snaps into the opening 46 and thereby locks the base within the socket.

The base 3, together with the bulb 2, may be removed from the socket 4 by passing a pointed implement through opening 46 in the socket to press locking element 39 towards stem 33 of the base. The pointed implement may then be used to push the base slightly in the outward direction, until shoulder 39*a* of locking element 39 clears the upper edge of opening 46. The implement may then be withdrawn from opening 46, whereupon the tapered surface 39*b* of locking element 39 will cause the base 3 to pop-out from cavity 42 of the socket 4.

It will thus be seen that the illustrated light bulb assembly provides positive locking of the bulb base within the socket, enables the base to be applied and locked in the socket by a simple insertion movement, and permits the base to be easily removed whenever desired. It will also be seen that the illustrated assembly is constituted of a few simple parts which can be produced and assembled in volume and at low cost.

While the invention has been described with respect to one preferred embodiment, it will be appreciated that many variations may be made. For example, the base 3 could be provided with a pair of the locking elements 39 on its opposite sides to more securely lock the base into the socket 4. Many other variations, modifications and applications of the invention will be apparent.

What is claimed is:

1. A light bulb assembly including a light bulb, a base receiving the light bulb, and a socket receiving the base;

said base being formed with a cavity at one end for receiving the light bulb, and with a displaceable arm extending from its opposite end and having a locking element at an outer tip thereof;

said socket including a side wall for enclosing said base, said side wall being formed with an opening therethrough having an edge adapted to receive said locking element to lock the base to the socket, the base being releasable from the socket by passing a pointed implement through said opening in said side wall to displace said arm and thereby to release the locking element from said edge;

said locking element being tapered such as to cause the arm, upon inserting the base into the socket, first to be deflected away from the opening until the locking element becomes aligned with the opening, and then to snap into said opening.

2. The light bulb assembly according to claim 1, wherein said socket includes an upper section of large diameter for receiving the base, and a lower section of smaller diameter for accommodating electrical conductors for energizing the lamp, said opening being formed at the juncture of said upper and lower sections.

3. The light bulb assembly according to claim 1, wherein said opening is elongated.

4. The light bulb assembly according to claim 1, wherein said arm extends parallel to the longitudinal axis of the base.

5. The light bulb assembly according to claim 4, wherein the light bulb includes an envelope and a pair of electrically-conductive wires projecting from one end of the envelope, and said base includes a stem extending from a lower end thereof for receiving said wires carried by the light bulb, said arm extending parallel to and laterally of said stem.

6. The light bulb assembly according to claim 5, wherein said wires exiting from the envelope are longer than said stem in the base and have ends which are folded back over the outside of the stem for securing the light bulb to the base.

7. The light bulb assembly according to claim 6, wherein said socket includes electrical conductors terminating in electrical contacts on an inner face of the socket so as to be engageable with said folded-back ends of the wire on the stem of the base when the base is inserted into the socket.

8. The light bulb assembly according to claim 7, wherein the socket is of rectangular configuration having a pair of opposed short sides and a pair of opposed long sides; said opening receiving the locking element at the outer tip of said displaceable arm being formed in one of said long sides of the socket; said electrical contacts being attached to the opposed short sides on the inner face of the socket.

9. A light bulb assembly including a light bulb, a base receiving the light bulb, and a socket receiving the base;

said base being formed with a cavity at one end for receiving the light bulb, and with a displaceable arm extending from its opposite end parallel to the longitudinal axis of the base and having a locking element at an outer tip thereof engageable with an inner surface of said socket when received therein;

said socket including a side wall for enclosing said base, said side wall being formed with an opening therethrough having an edge adapted to receive said locking element to lock the base to the socket;

said arm being displaceable with respect to said base from a normal locking position wherein its locking element engages said edge of the opening in said side wall and thereby locks the base within the socket, to a releasing position wherein its locking element disengages from said edge and thereby permits removal of said base from said socket.

10. The light bulb assembly according to claim 9, wherein said socket includes an upper section of large diameter for receiving the base, and a lower section of smaller diameter for accommodating electrical conductors for energizing the lamp, said opening being formed at the juncture of said upper and lower sections.

11. The light bulb assembly according to claim 9, wherein said opening is elongated.

12. The light bulb assembly according to claim 9, wherein said locking element is tapered such as to cause the arm, upon inserting the base into the socket, first to be deflected away from the opening until the locking element becomes aligned with the opening, and then to snap into said opening.

13. The light bulb assembly according to claim 9, wherein the light bulb includes an envelope and a pair of electrically-conductive wires projecting from one end of the envelope, and said base includes a stem extending from a lower end for receiving said wires carried by the light bulb, said arm extending parallel to and laterally of said stem.

14. The light bulb assembly according to claim 13, wherein said wires exiting from the envelope are longer than said stem in the base and have ends which are folded back over the outside of the stem for securing the light bulb to the base.

15. The light bulb assembly according to claim 14, wherein said socket includes electrical conductors terminating in electrical contacts on an inner face of the socket so as to be engageable with said folded-back ends of the wire on the stem of the base when the base is inserted into the socket.

16. The light bulb assembly according to claim 15, wherein the socket is of rectangular configuration having a pair of opposed short sides and a pair of opposed long sides; said opening receiving the locking element at the outer tip of said displaceable arm being formed in one of said long sides of the socket; said electrical contacts being attached to the opposed short sides on the inner face of the socket.

* * * * *